US007594661B2

(12) United States Patent
McLaughlin, Jr.

(10) Patent No.: US 7,594,661 B2
(45) Date of Patent: Sep. 29, 2009

(54) PLAYING CARD READING DEVICE AND METHOD

(76) Inventor: John W. McLaughlin, Jr., 9 Wheelwright La., Cherry Hill, NJ (US) 08003

( * ) Notice: Subject to any disclaimer, the term of this patent is extended or adjusted under 35 U.S.C. 154(b) by 258 days.

(21) Appl. No.: 11/640,571

(22) Filed: Dec. 18, 2006

(65) Prior Publication Data

US 2008/0143049 A1 Jun. 19, 2008

(51) Int. Cl.
*A63F 1/10* (2006.01)

(52) U.S. Cl. ..... 273/150; 273/148 R; 273/148 A

(58) Field of Classification Search ..... 273/148 A, 273/148 R, 150, 151, 309, 274; 463/40, 463/46, 12

See application file for complete search history.

(56) References Cited

U.S. PATENT DOCUMENTS 1,152,158 A 8/1915 Falk
3,074,319 A 1/1963 McGovern
3,096,389 A 7/1963 Dudly
3,776,643 A 12/1973 Titoff
4,146,229 A 3/1979 Morse
5,039,102 A 8/1991 Miller
5,451,054 A * 9/1995 Orenstein ..... 273/148 R
5,681,039 A 10/1997 Miller
5,941,769 A 8/1999 Order
5,959,791 A 9/1999 Bagnato, III
2003/0052448 A1 3/2003 Bertrand
2003/0176209 A1 9/2003 Soltys et al.
2006/0163808 A1 * 7/2006 Belill ..... 273/150

* cited by examiner

*Primary Examiner*—Benjamin H Layno
(74) *Attorney, Agent, or Firm*—Norman E. Lehrer

(57) ABSTRACT

A gaming device and method with a ramp with an upper rear corner cut-out where cards are slid face down up the ramp so that the mirrors or a video camera allow the card indicia to be viewed, wherein gaming tables may be easily retrofitted for television viewing or casino monitoring.

5 Claims, 6 Drawing Sheets

PLAYING CARD READING DEVICE AND METHOD

FIELD OF THE INVENTION

This invention is directed to a device and method that allows playing cards to be read with essentially no risk of exposing them to opposing players or spectators.

BACKGROUND OF THE INVENTION

A large number of card games provide that a player may view the indicia on face of his or her playing card or cards while hiding the indicia from the opponent(s). For example, these cards in various stud poker games are called the player's "hole cards". In the popular seven-card stud game of Texas Holdem, each player has two hole cards that only the player can include with the five cards that are dealt face-up to be used by all of the players at the table with their own hole cards. It is to the players great advantage to keep the opponents and spectators from seeing his or her hole cards while the indicia is viewed first and generally repeatedly during the play of the hand. Each time the player wants to check the indicia on the face of the hole cards, the player is forced to bend the corners of the card(s) upwardly while hiding the indicia from the opponents and spectators, the latter generating the greatest risk when they are generally to the rear of the player. During the long hours of a tournament the player frequently has to bend down close to the table surface hundreds of times to see the indicia in order to hide the indicia from the opponents. The playing cards are quickly damaged by the bending increasing the chance of the cards being marked by the bend requiring that the cards be quickly taken out of service. Further, the process of bending over, peeking at the cards, rising back up, and repeating the process numerous times during the play of each hand is tiring during the long hours of duration of large tournaments.

Further, with the advent of televised poker tournaments, casinos must, if they wish to host such tournaments, modify at least one feature table with televised monitoring of the hole cards. This has entailed major construction modifications of the table with glass windows in the playing surface table-top so that video cameras from below can read the hole cards with little risk that anyone outside a closed booth can see the card indicia. This modification is quite expensive and makes the table less useful for standard play. Although the television production would be greatly enhanced if many tables were so equipped, the casinos have thus far been unwilling to modify more that a single table out of hundreds for these tournaments despite the advantages of monitoring the play with a replayable record of each hand.

United States Patent Publication 2003/0052448 A1 to Bertrand discloses a tray device to hold playing cards that includes transparent easel 16 on which the cards rest on retaining ledge 18 and mirror to allow viewing the identity of the cards without lifting them off the easel. Most importantly, the Bertrand device requires the lifting of the cards off the table surface and onto the easel. The "retaining ledge 18" prevents the cards from being slid up onto the easel without their being lifted off the table, even if the ramp were extended to the table surface. When Bertrand claims that the cards need not be lifted to be viewed, he is clearly claiming that advantage only after the cards have been lifted up and placed on the "easel portion 16". It is noted that the Bertrand reflection is a single mirror image and is difficult to read, particularly considering the viewing angle that may too low to see over the raised padded rail on many gaming tables.

U.S. Pat. No. 4,146,229 to Morse discloses a card holder and viewer device that includes transparent panel 16 on which the cards rest and mirror 3 to allow viewing the identity of the cards without lifting them off the panel that is not inclined. As in the Bertrand device the cards must be lifted off the table to place them on the transparent panel.

U.S. Pat. Nos. 5,039,102 and 5,681,039 to Miller disclose a Black Jack card reader using a single mirror 101.

U.S. Pat. No. 5,941,769 to Order discloses a card-dispensing device uses ramp 9 to dispense the cards only downwardly to the table surface such that the cards cannot be slid back up the ramp as the succeeding card(s) block the slot. Window 11 in the ramp is filled with prism 6 allowing the dispensing card to be read.

U.S. Pat. No. 5,959,791 to Bagnato, III discloses a sole of feet viewing device that includes a horizontal transparent panel on which the feet rest and mirror 42 to allow viewing the bottom of the feet. The device could not be used for playing cards without lifting them off the table to place them on the transparent panel.

United States Patent Publication 2003/0176209 to Soltys et al discloses an apparatus to read machine-readable indicia on playing cards.

U.S. Pat. No. 3,074,319 to McGovern, U.S. Pat. No. 3,776,643 to Titoff, U.S. Pat. No. 1,152,156 to Falk, and U.S. Pat. No. 3,096,389 to Dudley disclose reading and display devices that, along with the devices described in the patents listed hereinabove, do not meet the needs described above nor attain the objects of this invention described herein below.

SUMMARY OF INVENTION

It is an object of an embodiment of the present invention to provide a method and a device to allowing the reading the indicia of playing cards while giving virtually no chance that opponents or spectators can determine the hidden card(s) indicia.

It is a further object of an embodiment of the present invention to provide a method and a device to allowing the reading the indicia of playing cards while avoiding any bending or otherwise injuring the playing card(s).

It is an additional object of an embodiment of the present invention to provide a method and a device to allow the reading the indicia of playing cards after sliding the card(s) up an inclined panel directly from a table-top playing surface.

It is a further object of an embodiment of the present invention to provide a method and a device that allows the reading the hidden indicia of playing cards with minimal bending over by the player.

It is an additional object of an embodiment of the present invention to provide a method and a device allowing each player to read the indicia of playing cards attaining at least some of the objects herein and adapted to be securely attached to a playing surface.

It is a further object of an embodiment of the present invention to provide a method and a device that allows a standard gaming table to be retrofitted with minimal permanent alteration to the table to allow the card indicia of hole cards to be read with a camera without bending or lifting the cards. This retrofit of the gaming table with multiple devices of this invention provides a particularly effective support for microphones and multiple cameras on each apparatus of this invention to feed all aspects of the game to a computer for broadcast and/or monitoring the game by casino personnel.

An embodiment of the invention is a playing card viewing apparatus that includes a platform that includes a front, a rear, a bottom adapted to rest on a card playing surface, and an upper section supporting a ramp surface angled upwardly and rearwardly from the bottom, the ramp surface including a front lower edge adapted to abut the card playing surface and an upper rear corner, wherein a section of the ramp surface comprises a visual opening of sufficient shape and size to expose a corner card identification of at least one playing card lying on the ramp surface facing downwardly, and viewing means adapted to display a visual image of the corner card identification.

The apparatus of an embodiment of the invention preferably includes a visual opening proximate the upper rear corner comprising a cut-away of sufficient shape and size to expose a corner card identification of at least one playing card. The term "visual opening" is defined, as used herein, as a section of the ramp that is not visually obstructed, but may be solid as in a window of plastic or glass or may be a hole of any suitable shape. The apparatus of an embodiment of the invention further preferably includes viewing means adapted to display a visual image of the corner card identification to a person viewing the apparatus from above. The apparatus of an embodiment of the invention also preferably includes viewing means that is adapted to project or display a visual image of the corner card identification to a person viewing the playing card from above the rear corner. The apparatus of an embodiment of the invention further preferably includes viewing means that comprise a pair of mirrors adapted by position and angles to allow an image of the corner card identification to be read by a person positioned above the apparatus. The apparatus of an embodiment of the invention also preferably includes a first mirror facing frontwardly and located below and rearwardly of the cut-away section of the ramp surface and a second mirror facing rearwardly and located above the first mirror, wherein the mirrors are positioned and angled to allow an image of the corner card identification to be read by person positioned above the apparatus. The ramp surface of an embodiment of the apparatus of the invention further preferably includes a surface area of sufficient size and shape to support at least two playing cards overlapped to expose the corner card identifications of both cards in the cut-away section of the ramp surface. The ramp surface of the playing card viewing apparatus is also preferably angled upwardly and rearwardly at an angle of 25 to 35 degrees from the bottom. The apparatus of an embodiment of the invention further preferably is adapted to be securely attached to a card-playing surface. The apparatus of an embodiment of the invention wherein the viewing means also preferably comprises a video camera.

The viewing means of an apparatus of an embodiment of the invention also preferably includes (1) two mirrors, examples of which are shown in FIGS. 1 through 3, namely mirror 74 and mirror 76, further described in paragraph 0030, and in FIG. 4, namely mirror 74' and mirror 76', further described in paragraph 0032; (2) a prism, examples of which are shown in FIG. 5, namely prisms 112, 112' and 112", further described in paragraph 0033; (3) a video camera, examples of which are shown in FIGS. 4 and 6, namely camera 44 and camera 122, respectively, further described in paragraphs 0032 and 0034; and (4) all mechanisms that will allow a player or designated persons to view the card indicia directly or through an electronic mechanism while the card(s) are lying on the ramp of an apparatus of the invention.

A second embodiment of the invention is a method of viewing playing cards that includes providing a playing card viewing apparatus that includes a platform that includes a front section, a rear section, a bottom adapted to rest on a card playing surface and an upper section supporting a ramp surface angled upwardly and rearwardly from the bottom, the ramp surface including a front lower edge adapted to abut the playing surface and an upper rear corner, wherein a section of the ramp surface comprises a visual opening of sufficient shape and size to expose a corner card identification of at least one playing card lying on the ramp surface facing downwardly. The apparatus further includes viewing means adapted to display a visual image of the corner card identification. The method further includes sliding a playing card facing downwardly up the ramp surface and positioning corner indicia of the card over the cut-away section.

It is preferred that the method further include providing an apparatus including viewing means adapted to display a visual image to a person viewing the playing card from above the apparatus. It is also preferred that the method further include securing the apparatus of an embodiment of the invention to a card-playing surface. It is further preferred that the method further include providing a playing card viewing apparatus for each of a multiplicity of players at a card table, wherein the viewing means of each apparatus comprising a video camera with a cable attached and adapted to transmit the visual image of the corner card identification, and feeding the cable of each apparatus through a hole in the card-playing surface and securing each apparatus to the card-playing surface of a table.

A third embodiment of the invention is a playing card viewing apparatus that includes a platform that includes a front, a rear, a bottom adapted to rest on a card playing surface, and an upper section supporting a ramp surface angled upwardly and rearwardly from the bottom, the ramp surface including a front lower edge adapted to abut the card playing surface and an upper rear corner, wherein a section of the ramp surface proximate the upper rear corner is cut-away of sufficient shape and size to expose a corner card identification of at least one playing card lying on the ramp surface facing downwardly, and viewing means adapted to display a visual image of the corner card identification.

DESCRIPTION OF PREFERRED EMBODIMENTS

Figure 1:
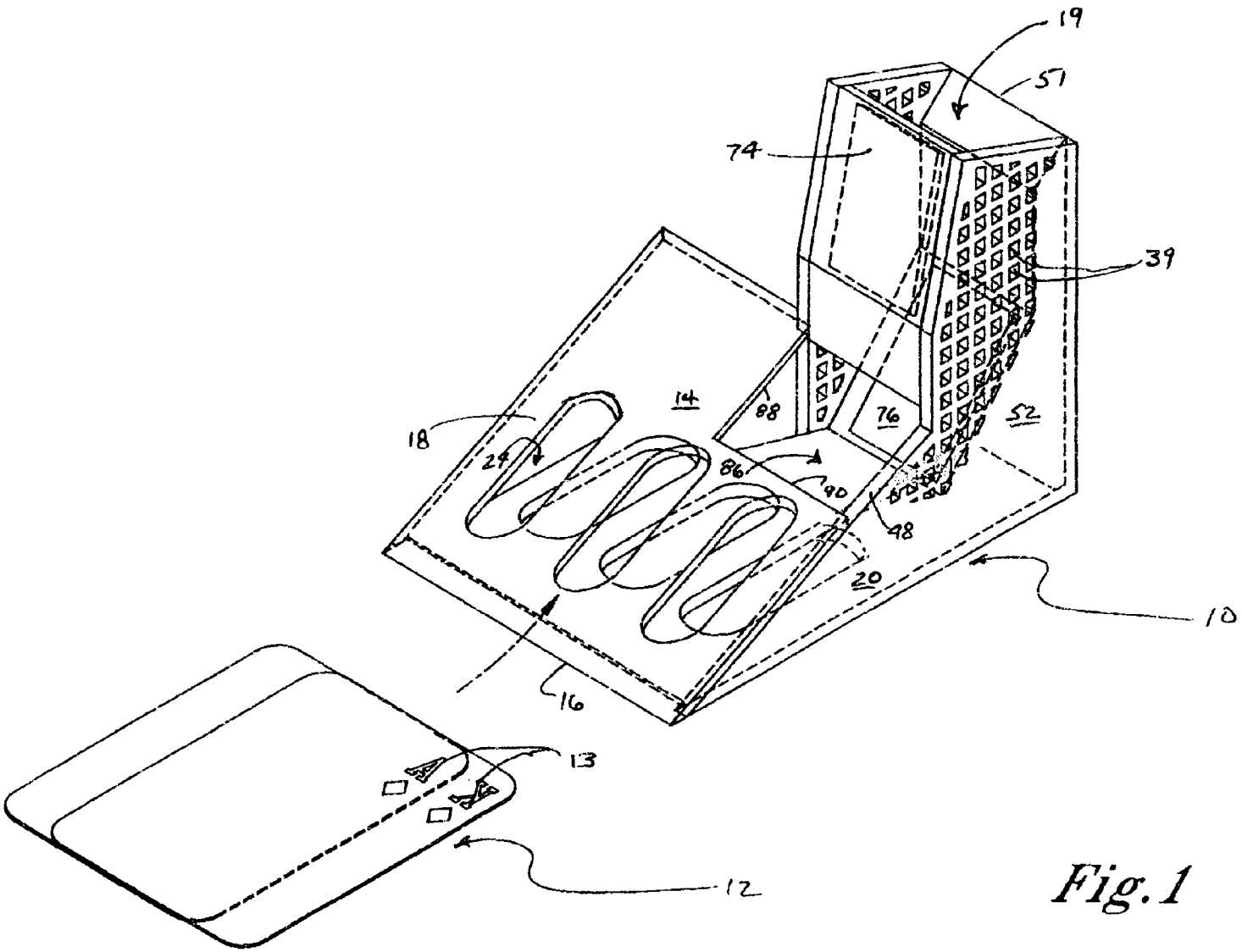
FIG. 1 is a front left side perspective view of an apparatus of the present invention.
Figure 2:
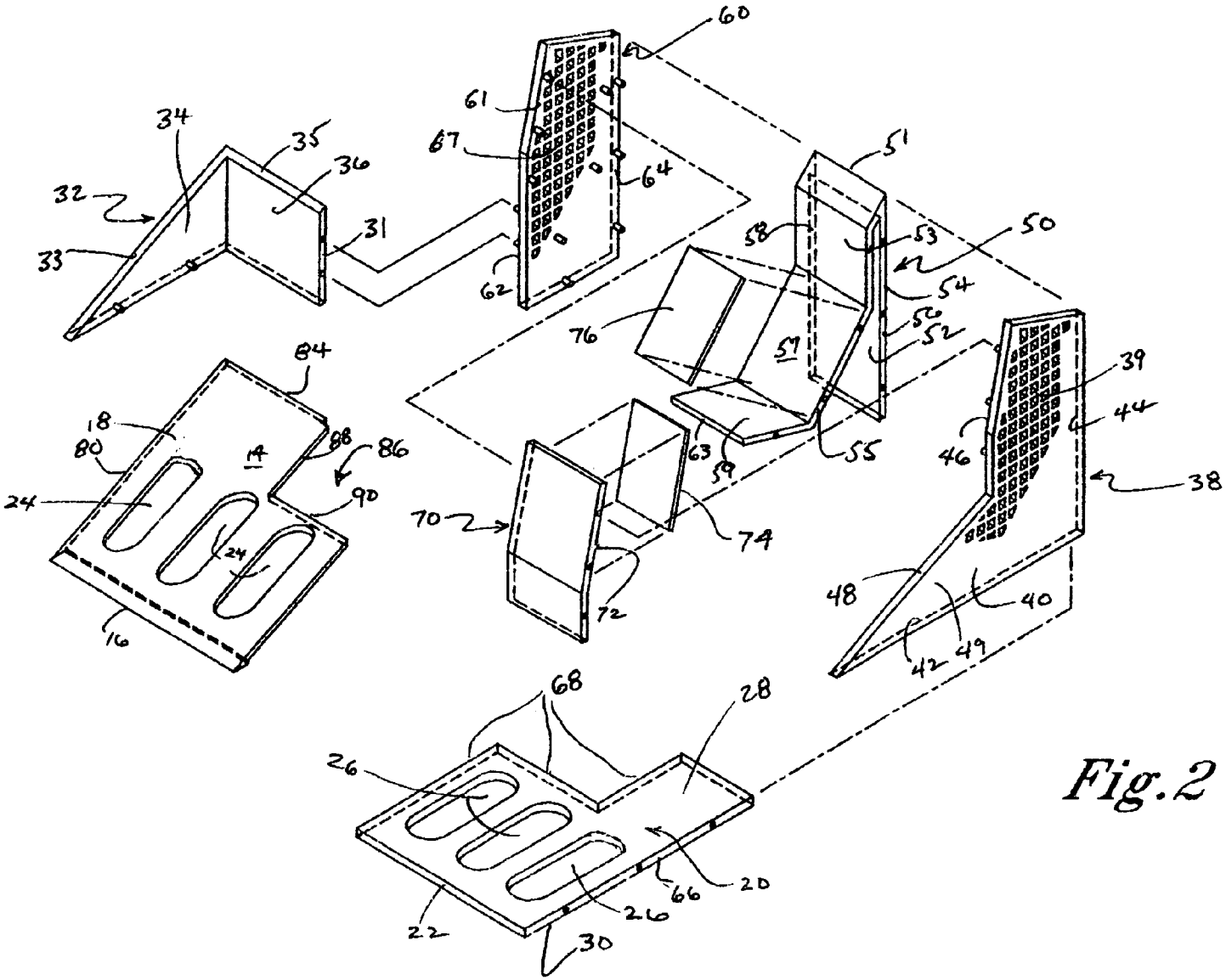
FIG. 2 is a front left side perspective exploded view of said apparatus.
Figure 3:
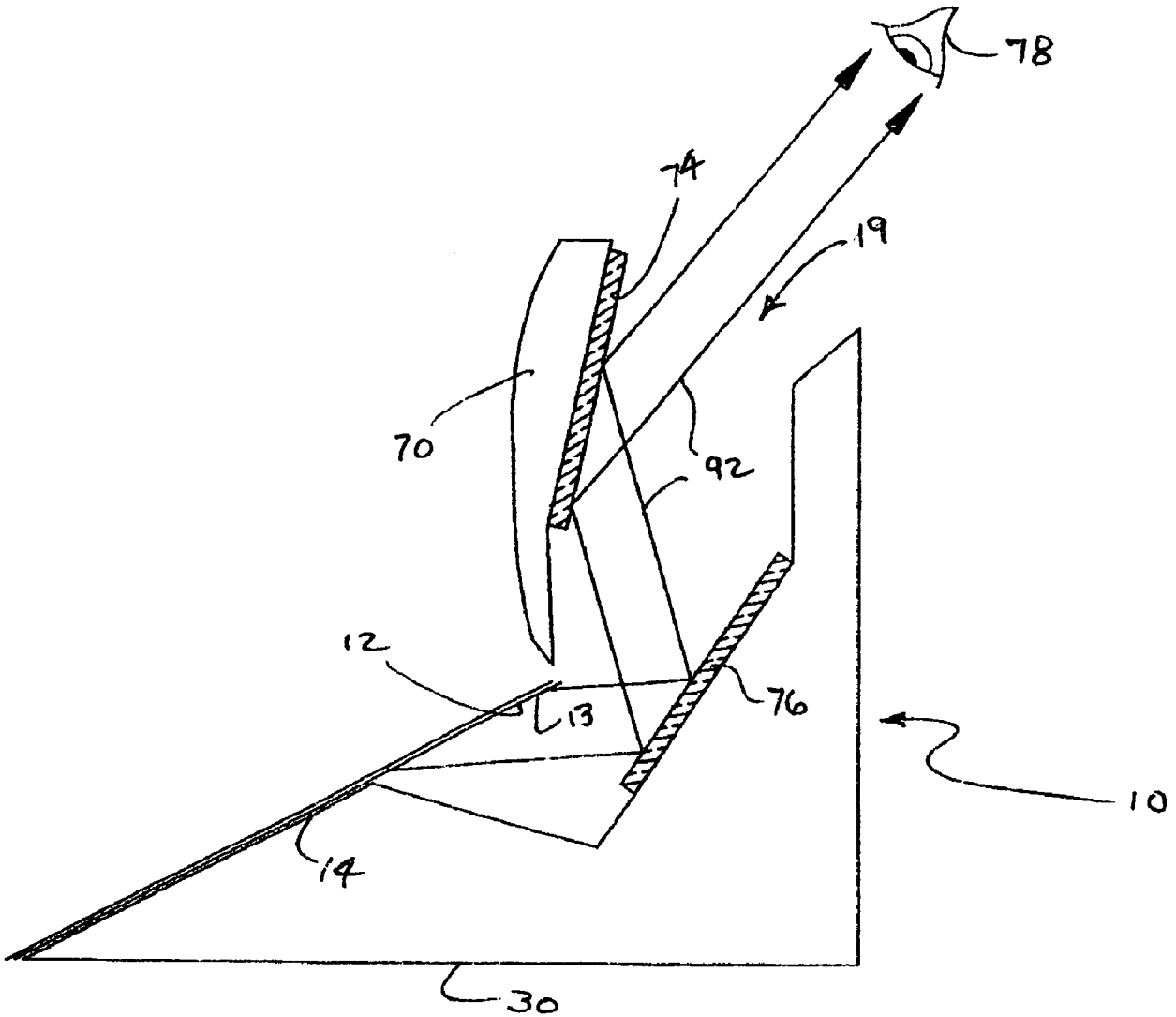
FIG. 3 is a left side diagram of said apparatus.

Playing card viewing apparatus 10 is illustrated in FIGS. 1 through 3. In FIG. 1 the broken lines show portions of elements hidden in the perspective view with all of these elements shown in the exploded perspective view of FIG. 2. In FIG. 1 cards 12 are shown lying face down with card indicia 13 (the king and ace of diamonds) hidden on a flat table surface, that is not shown, but is in a plane of the face of cards 12 and the bottom surface of apparatus 10. Cards 12, which are typically about two and 7/16 inches wide and about three and one-half inches long, are shown by the arrow to be slid up on ramp surface 14 past sharp leading front edge 16 of ramp 18. Front edge 16 is constructed to abut the flat table surface and may extend slightly below bottom surface 30 of apparatus 10 so as to slightly indent into the resilient fabric surfaces of most card playing tables. This allows the card or cards to be easily slid up onto ramp 18 without lifting the cards whatsoever and the card indicia easily viewed by looking downwardly through viewing opening 19.

Apparatus 10 is shown constructed of a multiplicity of panels, made of metal or plastic, but this is not critical, necessary or even preferred. For example, the lower section of apparatus 10 is shown as a housing, but it houses nothing and acts as a platform for ramp 18. This lower section bounded by the frontward section of ramp 18, bottom panel 20, left wall panel 32, lower section 40 of right wall panel 38, lower rear section 52 of rear wall panel 50, and inclined forward section 54 of rear wall panel 50 is shown as a hollow housing, but may be a solid block of metal or plastic. Holes 24 through ramp 18 and holes 26 through bottom panel 20 open the interior of the housing to scrutiny to insure that no card, chip or other object can be hidden inside. Holes 24 and 26 are the same size and aligned to illustrate their utility if it is chosen to make the lower section a solid block and drill the holes through the block. The size and shape of the holes and the interior of the housing prevent hiding either a card or even a chip and the openings are mere assurance that there is nothing hidden inside.

The panels shown exploded in FIG. 2 are attached together along their respective edges by adhesive, pins and holes as shown, welding or other connecting systems known in the art. Bottom edge 42 of right vertical wall panel 38 is rigidly connected with the aid of pins and holes as shown to right lengthwise edge 66 of bottom panel 20. Left wall panel 32 is an "L" shaped vertical panel with rear vertical edge 31 attached to the outside lower edge section 62 of left rear vertical wall panel 60 with the aid of pins and holes as shown to form the whole left wall. The bottom edges of left wall panel 32 and left rear wall panel 60 are connected with the aid of pins and holes as shown to the entire left lengthwise edge 68 of bottom panel 20. Vertical rear wall section 54 of rear wall panel 50 is connected along the vertical length of right edge 56 with the aid of pins and holes as shown to the inside of vertical rear edge 44 of right wall panel 38. Likewise vertical rear wall section 54 of rear wall panel 50 is connected along the vertical length of left edge 58 with the aid of pins and holes as shown to the inside of vertical rear edge 64 of left wall panel 60. The bottom edge of rear wall panel lower section 52 abuts and closes to the rear-most edge of the top surface of bottom panel 20. Rear wall panel 50 is formed in one piece with rear vertical wall section 54 depending downwardly from upper edge 51 to the rear of frame vertical wall section downwardly depending from edge 51 to connect with an upper edge of sloped wall section 55 to hold rear reflection mirror 76 to its front surface 57. Rear panel 50 continues to extend from the lower edge of section 55 through generally horizontal section 59 which angles slightly upwardly to terminate at front edge 63 abutting and rigidly connected to front edge 90 of cut-out section 86 to close the enclosure. The right and left edges of sections 53, 55, and 59 are rigidly connected to right wall panel 38 and left rear wall panel 60 respectively with the aid of pins and holes as shown. Front wall panel 70 is close to vertical with flat interior rear-facing surface 72, and thus the angle of flat mirror 74 attached to the surface, with the bottom angled outwardly to the front at about ten to fifteen degrees, preferably about twelve degrees, from the vertical. The right and left vertical edges of panel 70 are rigidly connected to upper front edge section 46 of right wall panel 38 and to upper front edge section 61 of left rear wall panel 60 respectively with the aid of pins and holes as shown. Flat viewing mirror 74 is securely attached to surface 72 so that it is angled downwardly at about 12 degrees from the vertical so that the image can be easily viewed by a player as illustrated in FIG. 3. Flat reflection mirror 76 facing upwardly and to the front, angled upwardly from the vertical about 25 to 40 degrees, more preferably about 30 to 35 degrees, is positioned to the rear of the exposed indicia of card 12 to receive the mirror image and reflect it to mirror 74 which is viewed as a plain image by viewer 78. Both of the mirrors are about seven-eighths inch wide and about one and one-half inches long. In the mirror configuration above, the player can easily view the card indicia when the player is positioned about seven inches above the table surface and about five inches behind the rear edge of the card on the ramp. Screen area 39 cut through right wall panel 38 and screen area 67 cut through left rear wall panel 60 have about 3/32 inch square openings with the screen elements being about 1/16 inch thickness to increase incident light to the mirrors to improve viewing without any risk of allowing other players or spectators to see anything.

Left edge 80 of ramp 18 is rigidly connected to sloping upper edge 33 of front section 34 of left wall panel 32 while right edge 82 of the ramp is rigidly connected to sloping upper edge 48 of front section 49 of right wall panel 38. Ramp 18 is sloped upwardly front to back at about twenty to about forty degrees, more preferably about twenty-five to about thirty-five degrees, and most preferably about thirty degrees. Transverse rear edge 84 of ramp 18 is rigidly attached to upper edge 35 of transverse rear section 36 of left wall panel 32. A cut-away or notch from ramp 18 designated 86 is cut out of the rear right corner of the ramp bounded by lengthwise edge 88 and transverse edge 90. Ramp 18 is about three and one-half inches long, which is about as long as most playing cards and three and one-quarter inches wide, while the visual opening, in this case, cut-away notch 86, is about an inch long and about ¾ to about one inch wide. With apparatus 10 it is easy to view the indicia of two overlapping playing cards at the same time. Enlarging the visual opening and the ramp width allows a greater number of cards to be viewed at the same time. For example, if the device were provided to view seven hole cards at the same time the visual opening might be about three and half inches wide. The width of ramp 18 and the mirrors would also be wider to accommodate the larger number of cards. Optical path 92 of apparatus 10 is illustrated in the diagram of FIG. 3 from the card indicia 13 of cards 12 reflected in mirror 76 upwardly and slightly frontwardly to mirror 74 which can be easily viewed by viewer 78. The image of the card indicia in mirror 74 is not a mirror image distortion to the viewer but is a normal image.

Figure 4:
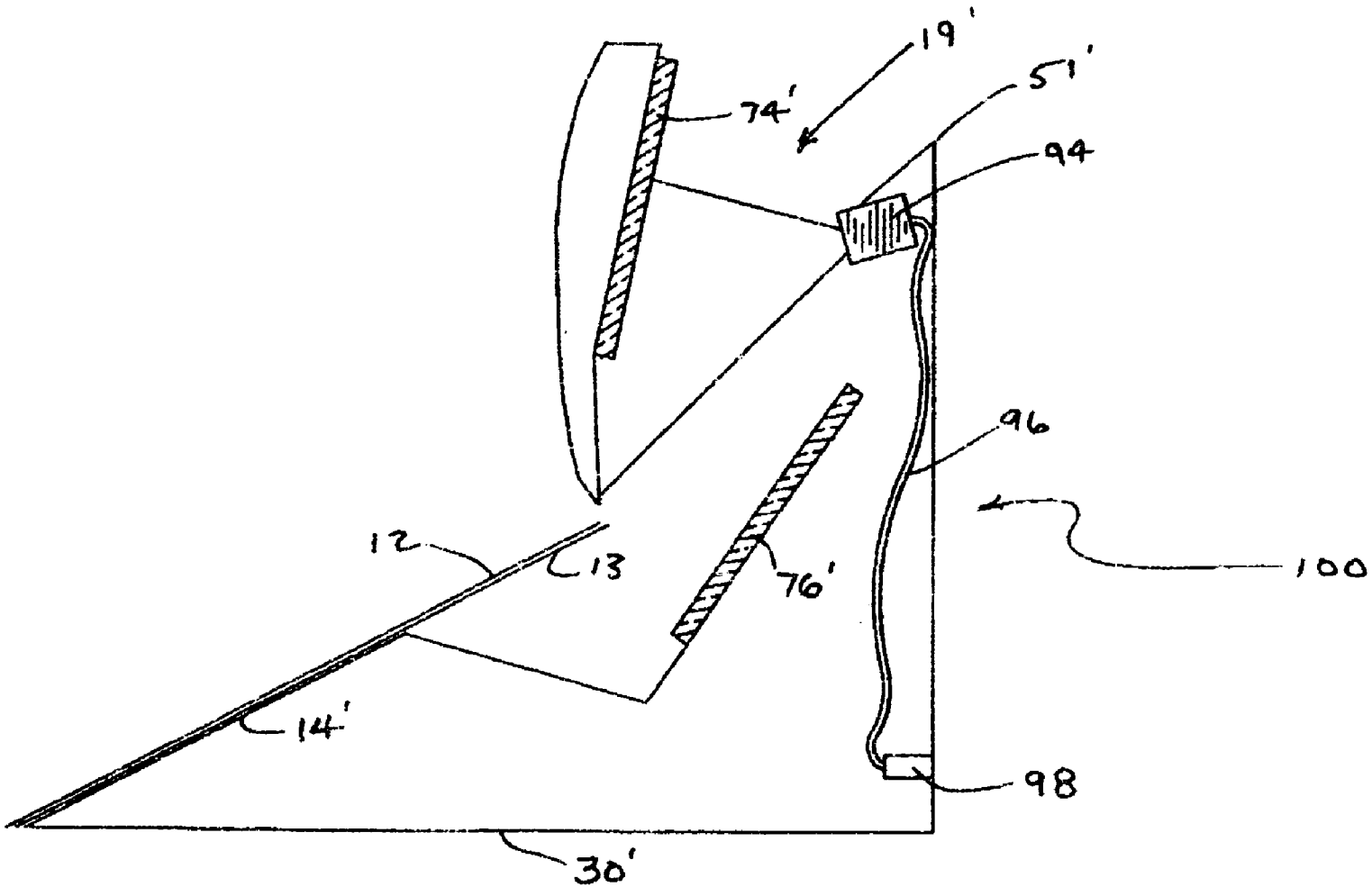
FIG. 4 is a left side diagram of a second embodiment apparatus of the invention.

Apparatus 100 as shown in FIG. 4 is a diagram of a second embodiment of this invention, which is essentially identical to apparatus 10 with essentially identical elements marked with a prime. For example, the optical path of apparatus 100, although not shown, from card indicia 13 to mirror 76' to mirror 74' to the viewer, not shown, is unimpeded and is essentially identical to that of apparatus 10. Video camera 94 is fixed close to upper edge 51' directed at mirror 74' leaving viewing opening 19' unimpeded. Camera 94 is connected by wire 96 of universal plug 98 adapted to be connected to a central source. This embodiment allows the player to use the apparatus while a commentator in a closed room can give an in sync feed to video viewers. This embodiment allows a permanent record of the play required by many casinos without a major modification to the gaming table.

Figure 5:
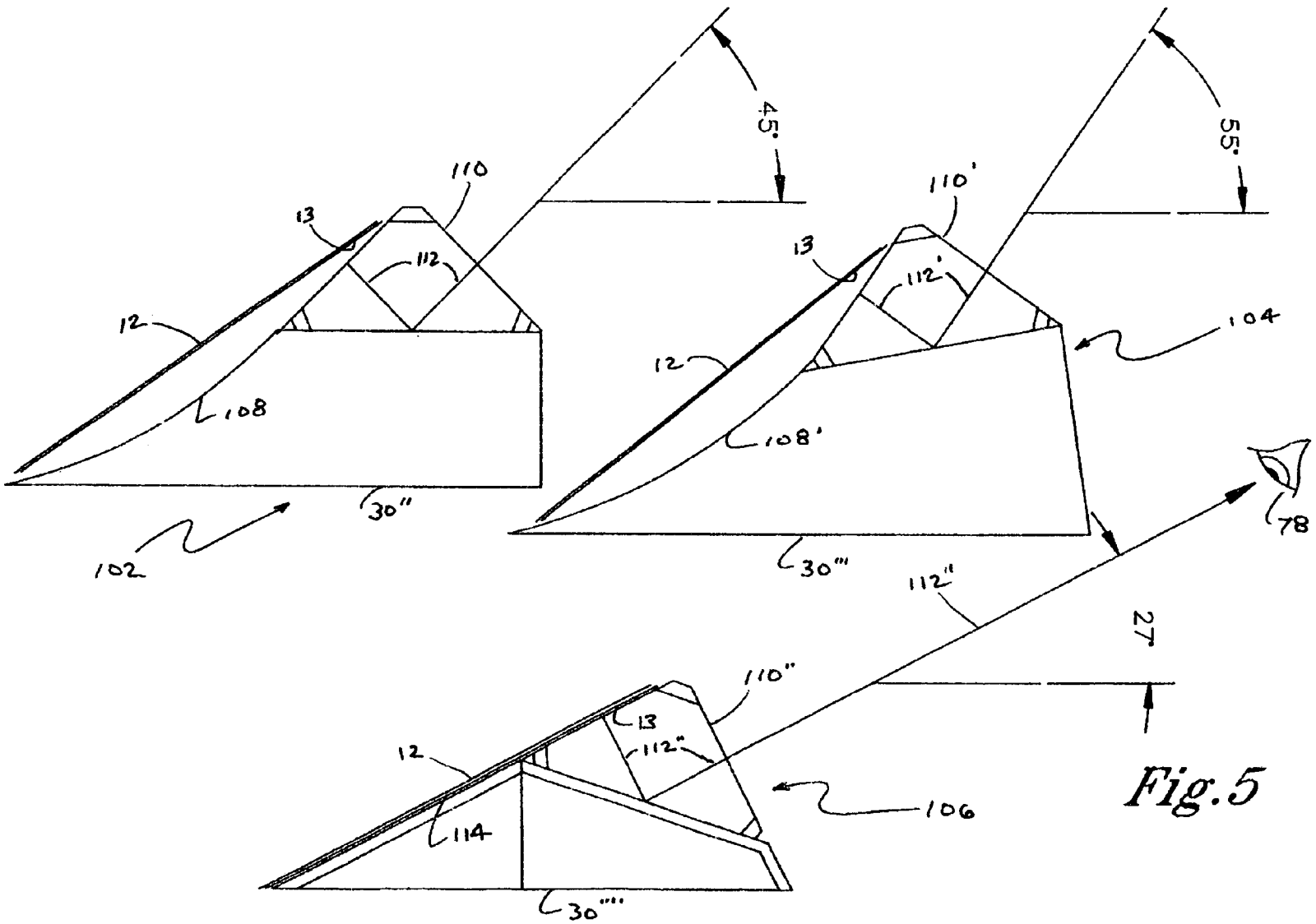
FIG. 5 is a left side diagram of a third embodiment apparatus of the invention illustrating three different positions of viewing mechanisms providing three different viewing angles to a card player.

The diagrams of FIG. 5 illustrate three differing optical paths from card indicia 13 to viewer 78 using a prism with apparatus embodiments 102, 104, and 106, that are each similar to apparatus 10, such as bottoms 30', 30''', and 30'''', except where noted. Prisms 110, 110', and 110'' of apparatus 102, 104, and 106, respectively, are identical 45/45/90 degree prisms angled horizontally, upwardly and downwardly to the rear to provide viewing angles 112, 112', and 112'' upwardly from the horizontal of 45, 55, and 27 degrees, all respectively. This illustrates how a pair of mirrors may also be angled to vary the viewing angle. Ramps 108 and 108' of apparatuses 102 and 104 are concave, but flat ramps, such as ramp 114 of apparatus 106, are preferred.

Figure 6:
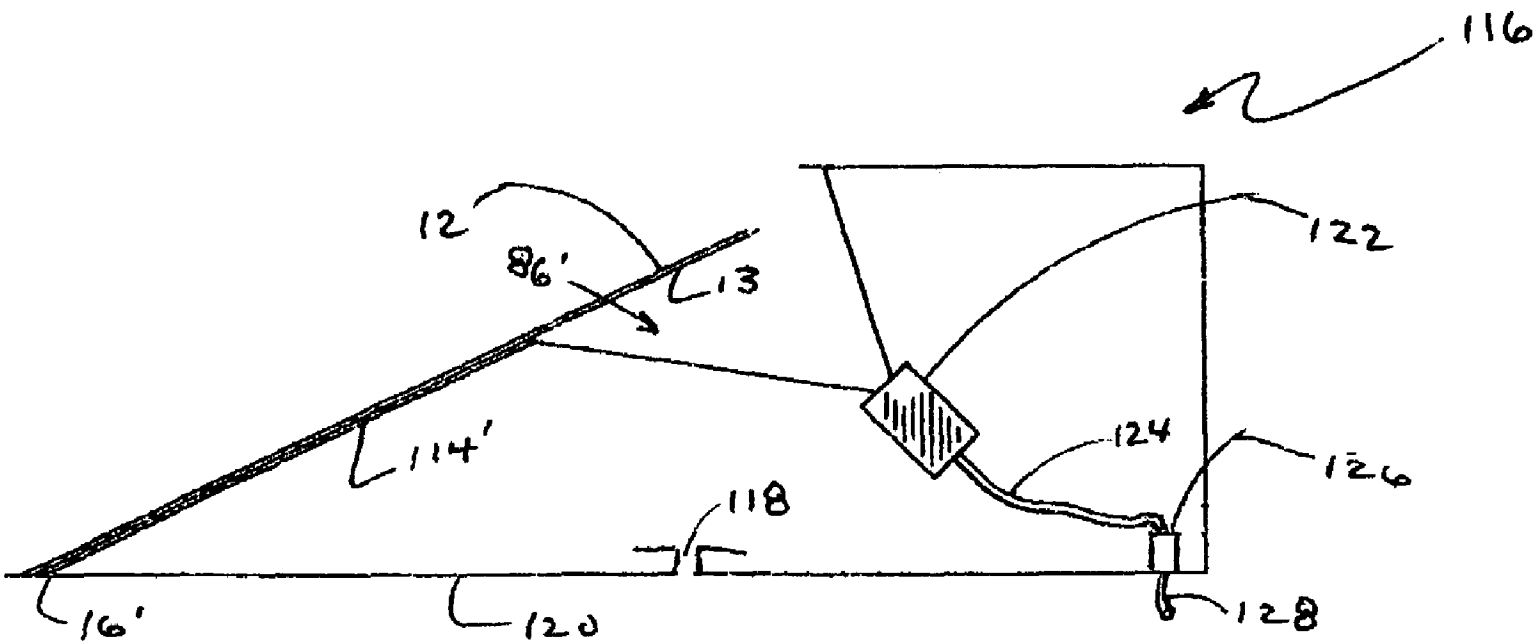
FIG. 6 is a left side diagram of a fourth embodiment apparatus of the invention.

The diagram of FIG. 6 of apparatus 116 illustrates an embodiment specifically effective in retrofitting gaming tables for the large tournaments covered by television. To address the problems described hereinabove a multiplicity, generally eight to a dozen, preferably eleven of apparatuses 116 are spaced around the periphery of the table and securely fastened to the top of the playing surface by screws or bolts through holes 118 through bottom 120 holding leading edge 16' of ramp 114' against the felt of the playing surface. Video camera 122 is fastened inside the housing of apparatus to the rear and below cut-away 86' to read indicia 13 of cards 12 and transmit the images along wire 124 to connector 126, which is fastened to the upper surface of bottom 120. Connecting wire 128 from connector 126 extends out of bottom 120 adapted to be fed through a small hole in the playing surface to connectors to the video feed located below the table surface. Using a multiplicity of apparatuses 116 a gaming table may be retrofitted for video with minimal modification and damage to the table. The players slide cards 12 up ramp 114' to be read by the video camera 122 and then proceed with play. Apparatus 100 may be used in the same fashion to retrofit tables with the added advantage of the player being able to read the cards without lifting or sliding them off the ramp. In retrofitting the gaming tables to accommodate them for television and/or monitoring them for other purposes all of the apparatuses this invention may be easily modified to include a mini-microphone and additional cameras to capture all of the action at the table. For example a camera can be fixed proximate upper edge 51 directed to the rear at the player using the apparatus to capture his face. Another camera can be fixed proximate the upper edge of front wall panel 70 directed to the chips bet by the player and to the community cards. Yet another camera can be fixed proximate the upper edge of front wall panel 70 directed to the other players at the table and the dealer. All of this digital information can be fed through audio/video wiring exiting the bottom of the apparatus through the table to a 4 to 1 video feed combiner connected to audio and video feeds to a real-time digital audio/video recorder with twelve sets of inputs connected to Ethernet connection to network switch, all this latter in state of the art to provide local onsite and/or offsite recording, editing and redistribution of feeds for viewing by spectators and/or casino personnel. These cameras may be PTZ (point, tilt, and zoom) capable and may have a 360-degree field. Thus, the retrofitted tables can produce a true audio and visual reproduction of the table play for real-time, time delayed and/or a permanent record. The permanent record allows an "instant replay" of all the actions at the table to allow casino personnel to make judgments as to the propriety of play and possible cheating.

While this invention has been described with reference to specific embodiments disclosed herein, it is not confined to the details set forth and the patent is intended to include modifications and changes, which may come within and extend from the following claims.

I claim:

1. A playing card viewing apparatus comprising:

a housing having a front section, a rear section and a bottom adapted to rest on a card playing surface;

said front section including a ramp surface angled upwardly and rearwardly from the bottom toward said rear section, said ramp surface including a front lower edge adapted to abut said playing surface and a top;

an opening in said ramp surface of sufficient shape and size to expose a corner card identification of at least one playing card lying on the ramp surface facing downwardly;

said rear section including front, rear, left side and right side vertical walls, all of said walls extending upwardly above the height of the top of said ramp surface, the top of said ramp surface intersecting said front vertical wall;

said vertical walls having inside surfaces that define a substantially rectangularly shaped tubular space, and viewing means adapted to display a visual image of the corner card identification.

2. The playing card viewing apparatus as claimed in claim 1 wherein said visual image can be seen only when looking downwardly into said space from above.

3. The playing card viewing apparatus as claimed in claim 2 wherein said viewing means includes a plurality of mirrors, at least one of said mirrors being positioned within said space defined by said vertical walls and being located above the top of said ramp surface.

4. The playing card viewing apparatus as claimed in claim 1 wherein the height of said vertical walls is more than twice the height of the top of said ramp surface.

5. The playing card viewing apparatus as claimed in claim 1 wherein said ramp surface allows a playing card to slide up from said card playing surface into viewing position and allows said card to slide downwardly from said ramp surface onto said playing surface without lifting said card from said ramp surface.

* * * * *